United States Patent [19]

Reuter et al.

[11] Patent Number: 4,591,214

[45] Date of Patent: May 27, 1986

[54] CABINET CLOSURE ASSEMBLY

[75] Inventors: Robert E. Reuter, Gravel Pike Palm, Pa.; Isidoro N. Markus, Rego Park, N.Y.

[73] Assignee: Knoll International, Inc., New York, N.Y.

[21] Appl. No.: 707,465

[22] Filed: Mar. 1, 1985

[51] Int. Cl.[4] ..... E05D 15/58

[52] U.S. Cl. ..... 312/110; 312/322; 312/331; 49/257; 49/197

[58] Field of Search ..... 49/254, 257, 197, 199; 312/110, 331, 138 R, 322

[56] References Cited

U.S. PATENT DOCUMENTS

| | | | |
|---|---|---|---|
| 726,957 | 5/1903 | Macey | 312/110 |
| 3,339,995 | 9/1967 | Bencene | 312/311 |
| 3,748,005 | 7/1973 | Chovanec | 49/197 |
| 4,058,932 | 11/1977 | Peterson et al. | 49/257 |
| 4,265,502 | 3/1981 | Blodee et al. | 49/254 |
| 4,375,907 | 3/1983 | Kooi et al. | 312/110 |

FOREIGN PATENT DOCUMENTS

| | | | |
|---|---|---|---|
| 522723 | 6/1940 | United Kingdom | 312/110 |

*Primary Examiner*—William E. Lyddane
*Assistant Examiner*—Gerald A. Anderson

[57] ABSTRACT

A cabinet of the type having an opening includes a panel which is pivotable between opening-blocking and opening-unblocking positions. The panel is slidable into the cabinet from its unblocking position along parallel spaced tracks, each of which includes a gear rack and a spur gear mounted thereon. An equalizer rod joins together the spur gears and is coupled to the panel to ensure free movement of the panel along the tracks. A tubing encloses the equalizer rod and is mounted for movement with that rod. The equalizer tube is coupled at opposite ends thereof to the tracks to prevent pivoting of the tube. Hinges are mounted to the tubing for supporting the panel for its pivotable movement.

6 Claims, 14 Drawing Figures

CABINET CLOSURE ASSEMBLY

BACKGROUND AND BRIEF DESCRIPTION OF THE INVENTION

This invention relates to cabinet closures. It is particularly directed to a cabinet of the type having an opening which is closed by a pivotable panel. That panel is pivoted to a position in which the cabinet opening is accessible, and the panel is then slid along tracks into the interior of the cabinet. The tracks conventionally include gear racks and spur gears mounted thereon, with the spur gears coupled together by an equalizer rod connected to the panel to ensure free movement of the panel along the tracks, preventing misalignment and jamming of the panel.

The present invention is directed to an improvement in such an assembly. In the past, the equalizer rod has conventionally served as a direct support for hinges that mount the panel that closes the cabinet opening. Such an arrangement tends to direct forces against the equalizer rod when the panel is being pivoted, forcing movement of the equalizer rod along the track. It is desirable to eliminate such forces. In the present invention, the equalizer rod serves only as an equalizing member, i.e., solely to link together the two spur gears to cause accurate movement of the panel within the cabinet. Pivotable support for that panel is provided by a tubing which surrounds the equalizer rod. By using such tubing, which can be made very rigid, strong support for the panel is provided, and forces tending to move the panel along the track may be minimized as the panel is pivoted. In the present invention, the ends of the tubing include projections which ride in channels along the associated tracks in the cabinet, preventing twisting of the tubing as the panel is pivoted, and yet providing good movement of the tubing along the tracks. Additionally, the end projections of the tubing which ride in the associated track channels resiliently engage portions of those channels at the ends of the channels to provide for positive positioning of the panel at its extreme positions of movement along the tracks in the cabinet.

The following patents are representative of prior systems including gear tracks and equalizer rods:

| U.S. Pat. No. | Applicant(s) | Issued |
|---|---|---|
| 3,339,995 | R. C. Bencene | 09/05/67 |
| 4,346,950 | H. Ueno et al | 08/31/82 |
| 4,375,907 | David Vander Kooi et al | 03/08/83 |

The invention will be more completely understood by reference to the following detailed description, taken in conjunction with the appended drawings.

DETAILED DESCRIPTION

Figure 1:
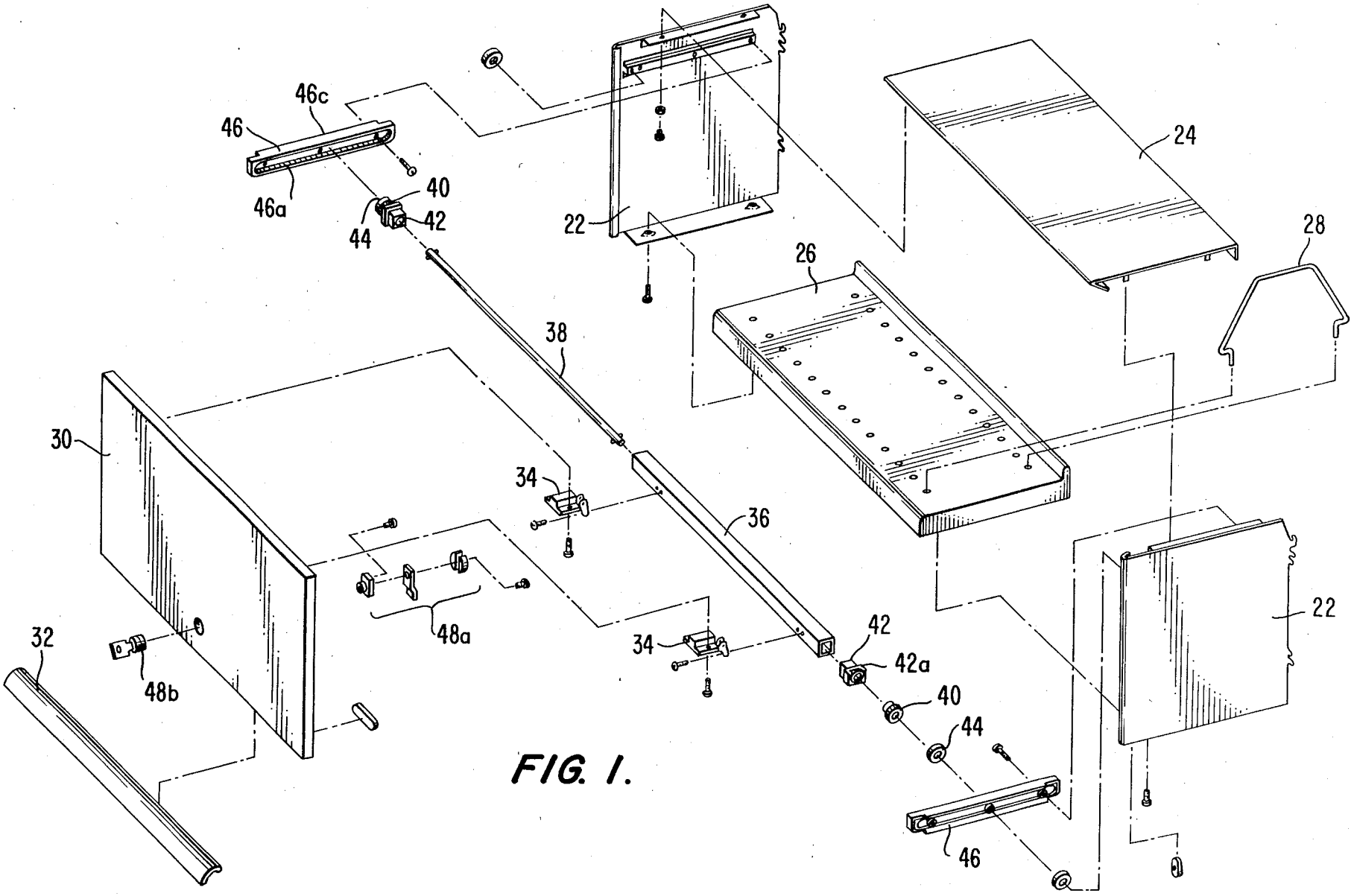
FIG. 1 is an exploded view of a cabinet assembly embodying the present invention.

Refer first to the exploded view of FIG. 1 which shows all the parts of a cabinet assembly that embodies the present invention. That assembly includes side pieces 22, a top 24, and a bottom 26. Shaped rods such as that designated 28 may be employed as dividers, which are positioned in corresponding holes in the bottom 26. A front panel 30 is included, having a lower handle 32. The panel 30 is mounted by hinges 34 to a tubing 36. That tubing surrounds an equalizer rod 38 which is pinned to gears 40 at the ends of the rod. The equalizer rod 38 is supported within the tubing at the ends thereof by bushings 42 which provide a bearing support for the rod. The extreme ends of the equalizer rod carry rollers 44 which ride in channels of track assemblies 46. A lock assembly **48*a*/48*b* essentially completes the assembly of parts shown in FIG. 1**.

Figure 2:
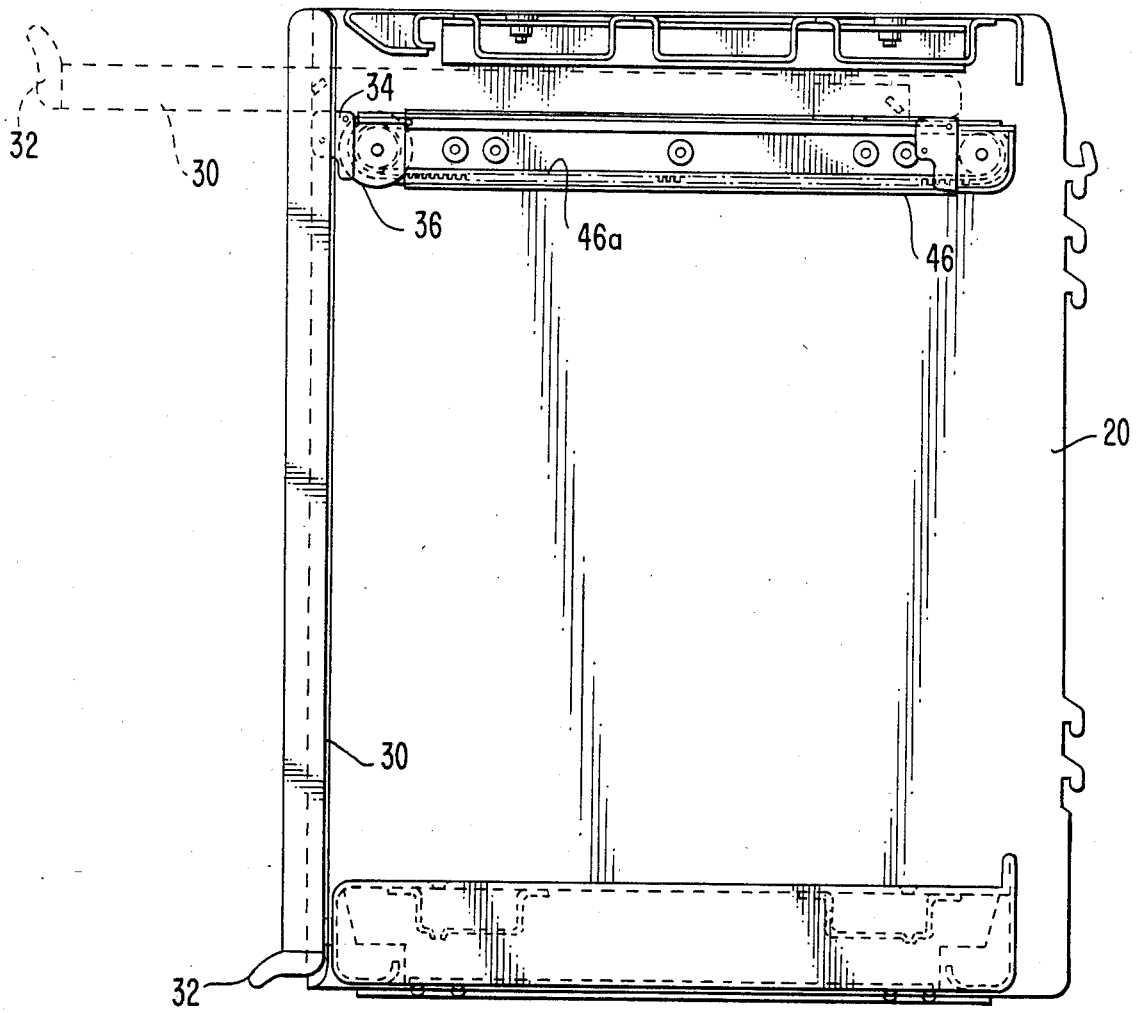
FIG. 2 is a side view of part of a cabinet assembly, assembled from the parts of FIG. 1, essentially constituting a view from the interior of the cabinet.

Refer to FIG. 2. The panel 30 is shown in full lines closing off the opening to the cabinet. In dash lines, the panel 30 is shown pivoted upwardly and moved almost entirely within the cabinet.

Figure 3:
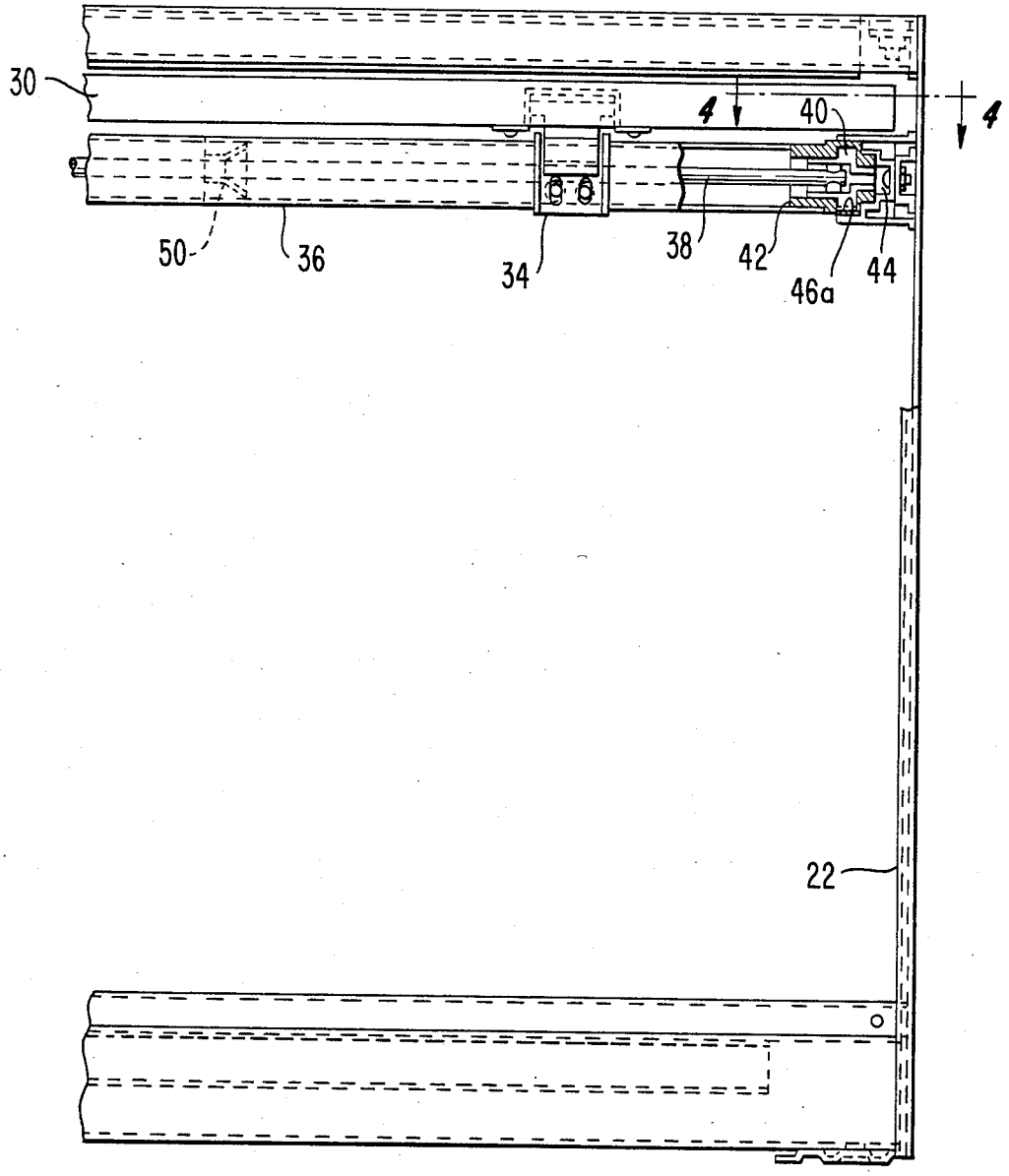
FIG. 3 is a partial front view of a cabinet as in FIG. 2, looking into the cabinet with the panel in position inside the cabinet, showing the details of the equalizer rod and panel-supporting tubing.
Figure 4:
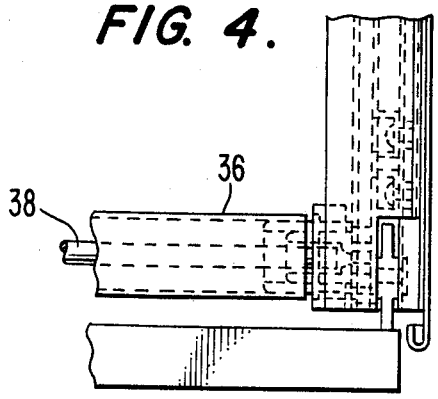
FIG. 4 is a sectional view taken along the section 4—4 in FIG. 3.

Refer to FIGS. 3 and 4. These figs show how the equalizer rod 38 is carried, by the bushings 42 at the ends thereof (only one bushing 42 is shown in FIG. 3). Additionally, an intermediate bushing 50 is included within the tubing 36 for providing intermediate support of the equalizer rod within the tubing.

Figure 5:
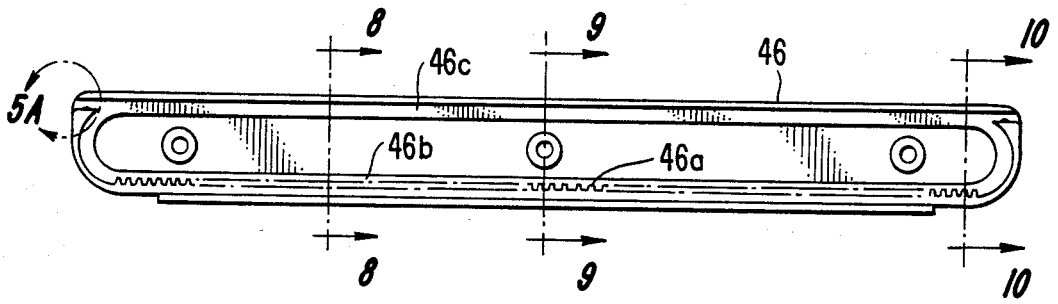
FIGS. 5 to 7 are respectively right-side, top, and left-side views of a track used in the cabinet assembly of FIGS. 1 to 4.
Figure 5A:
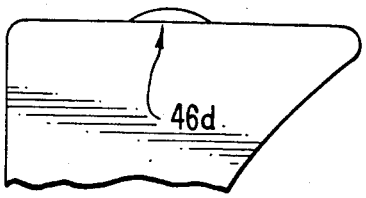
FIG. 5A is an enlarged fragmentary view of part of the track of FIGS. 5 to 7.
Figure 6:
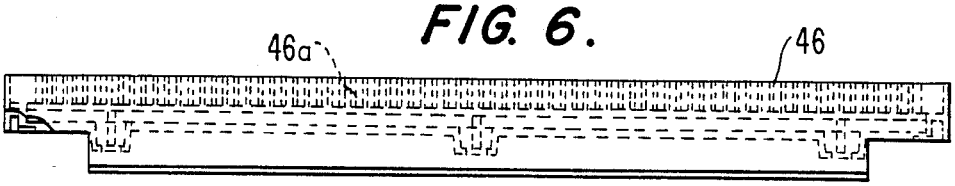
Figure 7:
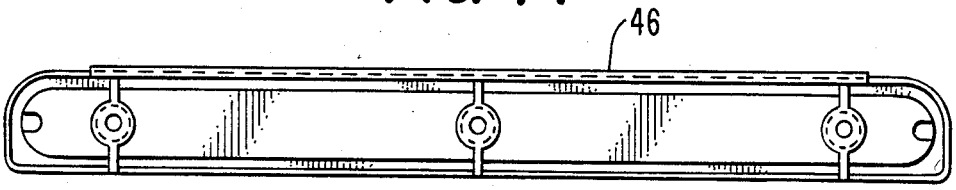
Figure 8:
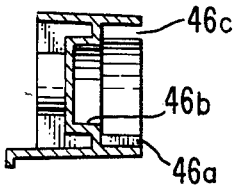
FIGS. 8 to 10 are sectional views taken along the respective section lines in FIG. 5.
Figure 9:
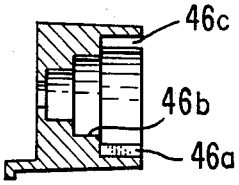
Figure 10:
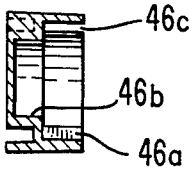

Refer now to FIGS. 5 to 7 and corresponding section FIGS. 8 to 10. These figures illustrate the track assembly 46. As will be noted, that track assembly includes a gear rack **46*a* as a part thereof. The associated spur gear 40 engages that gear rack. Because the equalizer rod 38 is pinned to spur gears 40 at both ends thereof, movement of the panel 30** within the cabinet is precise, and no misalignment nor jamming can occur.

As best shown in FIG. 5, the track 46 includes a channel **46*b* therealong within which the roller 44 rides. The rollers 44 thus provide rolling support for the equalizer rod assembly along the tracks 46, while the equalizing function (prevention of misalignment) is provided by the gears 40**.

Figure 11:
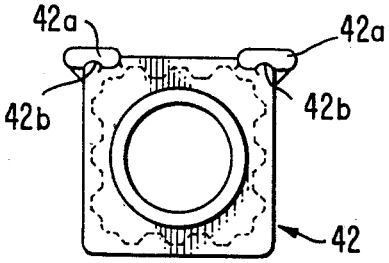
FIGS. 11 to 13 are respectively front and rear and side views of an end bushing used to support the equalizer rod within the enclosing tubing of the assembly of FIGS. 1 to 4.
Figure 12:
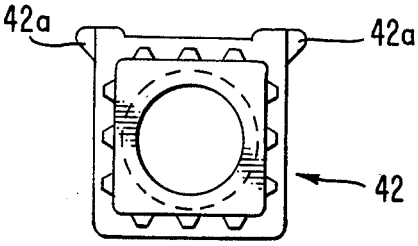
Figure 13:
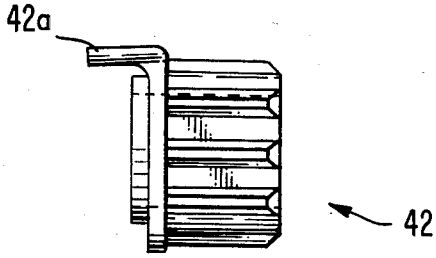

The track assembly 46 also includes a channel **46*c* at the upper portion thereof which receives end projections of the tubing 36, in this case provided by the bushings 42. These projections are designated 42*a* and are shown in detail in FIGS. 11 to 13. These end projections engage the track, while sliding along the track, and prevent pivoting of the tubing 36. In this fashion, the tubing 36, which provides support for the hinges 34 that mount the panel 30 for pivoting movement, in turn is positively supported for movement with respect to the tracks 46 in a fashion that prevents pivoting or twisting of that tubing. Such an assembly is positive, strong, and permits the equalizing rod 38 to provide for only the equalizing function, removing from that equalizing rod the pivotal support for the panel 30** conventionally provided by that rod in systems used in the past.

Refer to the detail of FIG. 5A and FIGS. 11 to 13. The track assembly 46, at the extreme ends of the channel 46*c*, includes protrusions 46*d*. These protrusions engage corresponding indentations 42*b* formed in the projections 42*a* that form parts of the end bushings 42. Thus as the panel is in its extreme positions of movement along the supporting tracks, the projections 46*d* engage the corresponding indentations 42*b* to provide positive and firm positioning of the panel in these positions. Particularly in the position of the panel 30 when it is closing the cabinet, it is desired not to have any movement of the spur gears 40 along the tracks 46 during pivoting of the panel 30 from its vertical (cabinet closed) position to the horizontal position of the panel (cabinet open). The protrusions 46*d* and indentations 42*b* provided for such positive positioning of the panel without movement of the spur gears along the track.

It should be apparent to those skilled in the art that the presently preferred embodiment of the invention described above is subject to modification. Accordingly, the invention should be taken to be defined by the appended claims.

We claim:

1. In a cabinet of the type having an opening, a panel pivotable between blocking and unblocking positions in which said opening is respectively blocked and unblocked by said panel, said panel being slidable into said cabinet from said unblocking position along parallel spaced tracks, each track including a gear rack, and spur gears mounted on said racks, and an equalizer rod joining together said spur gears and coupled to said panel for ensuring free movement of said panel along said tracks, the improvement comprising a tubing enclosing said equalizer rod and mounted for movement therewith and including means at the ends of said tubing coupled to said tracks for preventing pivoting of said tubing, and hinge means mounted to said tubing for supporting said panel for said pivotable movement thereof.

2. A cabinet assembly according to claim 1, in which said tubing includes an end projection at each end thereof, each track including a channel therealong for receiving the associated end projection for sliding movement of said associated end projection therein, the engagement of said end projections with said track channels preventing pivoting movement of said tubing.

3. A cabinet assembly according to claim 2, in which said end projections resiliently engage portions of the associated channels at the ends of said channels to provide for positive positioning of said panel at the extreme positions of movement of said panel along said tracks.

4. A cabinet assembly according to claim 1, in which said tubing includes a bushing at each end thereof, each end bushing supporting an associated one of said spur gears.

5. A cabinet assembly according to claim 4, in which each end bushing includes a projection, each track includes a channel therealong for receiving the associated projection for sliding movement of said associated projection therein, the engagement of said projections with said track channels preventing pivoting movement of said tubing.

6. A cabinet assembly according to claim 5, in which said projections resiliently engage portions of the associated channels at the ends of said channels to provide for positive positioning of said panel at the extreme positions of movement of said panel along said tracks.

* * * * *